US012662949B2

(12) United States Patent
Okuyama et al.

(10) Patent No.: US 12,662,949 B2
(45) Date of Patent: Jun. 23, 2026

(54) COMBINED CYCLE POWER GENERATION FACILITY

(71) Applicants: KABUSHIKI KAISHA TOSHIBA, Tokyo (JP); TOSHIBA ENERGY SYSTEMS & SOLUTIONS CORPORATION, Kawasaki (JP)

(72) Inventors: Tomomi Okuyama, Ota (JP); Hideaki Shimada, Yokohama (JP); Masao Itoh, Yokohama (JP); Yuichi Morisawa, Yokohama (JP); Hiroki Kasuya, Yokohama (JP); Ryu Hirayama, Yokohama (JP); Kojiro Tada, Yokohama (JP)

(73) Assignees: KABUSHIKI KAISHA TOSHIBA, Tokyo (JP); TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 19/025,071

(22) Filed: Jan. 16, 2025

(65) Prior Publication Data

US 2025/0154884 A1 May 15, 2025

Related U.S. Application Data

(63) Continuation of application No. PCT/JP2023/026223, filed on Jul. 18, 2023.

(30) Foreign Application Priority Data

Aug. 18, 2022 (JP) ..... 2022-130460

(51) Int. Cl.
*F01K 7/38* (2006.01)

(52) U.S. Cl.
CPC ..... *F01K 7/38* (2013.01)

(58) Field of Classification Search
CPC ... F01K 7/38; F01K 3/24; F01K 21/04; F01K 23/10; F01K 23/106; F02C 6/18; Y02E 20/16
(Continued)

(56) References Cited

U.S. PATENT DOCUMENTS 5,199,256 A * 4/1993 Moore ..... F01D 21/00 60/39.182
5,953,900 A 9/1999 Bannister et al.
(Continued)

FOREIGN PATENT DOCUMENTS

JP 9-144559 A 6/1997
JP 3068529 B 7/2000
(Continued)

OTHER PUBLICATIONS

International Search Report issued Aug. 29, 2023 in PCT/JP2023/026233 filed Jul. 18, 2023, 2 pages.

*Primary Examiner* — Hoang M Nguyen
(74) *Attorney, Agent, or Firm* — Oblon, McClelland, Maier & Neustadt, L.L.P.

(57) ABSTRACT

A combined cycle power generation facility of an embodiment includes: a gas turbine; a heat recovery steam generator including a high-pressure steam generation part which generates steam by using an exhaust gas of the gas turbine, and a reheat part which reheats steam; a high-pressure turbine to which the steam from the high-pressure steam generation part is introduced; an intermediate-pressure turbine provided on a downstream side of the high-pressure turbine; a reheat steam pipe connecting an outlet of the high-pressure turbine and an inlet of the intermediate-pressure turbine with the reheat part interposed therebetween; a combustor to which steam discharged from the intermediate-pressure turbine is introduced, and which combusts oxygen and hydrogen to reheat the introduced steam;
(Continued)

a low-pressure turbine to which steam discharged from the combustor is introduced; and a condenser which changes steam discharged from the low-pressure turbine into condensed water.

7 Claims, 2 Drawing Sheets

(58) Field of Classification Search
USPC ..... 60/39.182, 653, 677–679
See application file for complete search history.

(56) References Cited

U.S. PATENT DOCUMENTS

| | | | | |
|---|---|---|---|---|
| 7,316,105 | B2 | 1/2008 | Haberberger et al. | |
| 7,950,239 | B2 * | 5/2011 | Lilley | F02C 9/40 60/774 |
| 11,608,758 | B2 | 3/2023 | Tanimura et al. | |
| 11,834,968 | B2 | 12/2023 | Uechi et al. | |
| 2006/0266040 | A1 | 11/2006 | Haberberger et al. | |
| 2008/0010968 | A1 * | 1/2008 | Hartmann | F01K 7/16 60/39.182 |
| 2009/0056341 | A1 * | 3/2009 | Sanchez | F22G 1/165 60/39.182 |
| 2012/0043765 | A1 * | 2/2012 | Glasgow | F23C 99/00 290/1 R |
| 2013/0152598 | A1 * | 6/2013 | Thacker | F02C 6/04 60/774 |
| 2014/0102072 | A1 * | 4/2014 | Bowman | F02C 6/00 60/39.182 |
| 2019/0390577 | A1 | 12/2019 | Tanimura et al. | |

FOREIGN PATENT DOCUMENTS

| | | | |
|---|---|---|---|
| JP | 2005-320921 | A | 11/2005 |
| JP | 2006-514718 | A | 5/2006 |
| JP | 2007-503544 | A | 2/2007 |
| JP | 2018-123811 | A | 8/2018 |
| JP | 2021-85608 | A | 6/2021 |

* cited by examiner

COMBINED CYCLE POWER GENERATION FACILITY

CROSS REFERENCE TO RELATED APPLICATIONS

This application is based upon and claims the benefit of priority from Japanese Patent Application No. 2022-130460, filed on Aug. 18, 2022; the entire contents of which are incorporated herein by reference.

FIELD

Embodiments of the present invention relate to a combined cycle power generation facility.

BACKGROUND

In a thermal power plant in recent years, a demand for a combined cycle power generation facility having high plant thermal efficiency is increasing. A conventional combined cycle power generation facility includes a gas turbine, a heat recovery steam generator, a steam turbine, and a generator. In this combined cycle power generation facility, an exhaust gas at high temperatures from the gas turbine is introduced to the heat recovery steam generator. The steam turbine is constituted of, for example, a high-pressure turbine, an intermediate-pressure turbine, and a low-pressure turbine.

In the heat recovery steam generator, in order to effectively use a heat quantity of an exhaust gas from the gas turbine to generate steam, a configuration to include high-pressure, intermediate-pressure, and low-pressure steam generation parts at three pressure levels is adopted. The steam generated by the steam generation parts is introduced to the steam turbines.

In the conventional combined cycle power generation facility, in order to improve thermal efficiency, a reheat cycle in which steam exhausted from the high-pressure turbine is reheated by a reheat part of the heat recovery steam generator, and introduced to the intermediate-pressure turbine is adopted. In this case, a temperature of the reheat steam to be introduced to the intermediate-pressure turbine is set at, for example, about the same temperature as that of main steam to be introduced to the high-pressure turbine.

As described above, in the heat recovery steam generator, the exhaust gas from the gas turbine is used as a heat source for generating steam. Thus, a temperature of the exhaust gas decreases as the exhaust gas passes through the respective steam generation parts.

In a case of adopting the above reheat cycle and setting the temperature of the reheat steam to be introduced to the intermediate-pressure turbine at about the same temperature as that of the main steam to be introduced to the high-pressure turbine, in order to perform both production of steam and reheating of steam properly in the heat recovery steam generator, the number of times of reheating is limited to once. That is, in the conventional combined cycle power generation facility, the reheating in the heat recovery steam generator is limited to one-stage reheat.

Therefore, in the combined cycle power generation facility adopting a configuration of the conventional reheat cycle, it is difficult to obtain more improvement in thermal efficiency caused by the reheat than ever.

DETAILED DESCRIPTION

Hereinafter, embodiments of the present invention will be explained with reference to the drawings.

In one embodiment, a combined cycle power generation facility of an embodiment includes: a gas turbine; and a heat recovery steam generator including a steam generation part which uses a heat quantity of an exhaust gas from the gas turbine to generate steam, and a reheat part which reheats steam.

Further, this combined cycle power generation facility includes: a first steam turbine to which the steam generated by the steam generation part is introduced; a second steam turbine provided on a downstream side of the first steam turbine in a flow direction of a steam flow; a reheat steam pipe connecting a steam outlet of the first steam turbine and a steam inlet of the second steam turbine with the reheat part interposed therebetween; a combustor to which steam discharged from the second steam turbine is introduced, and which combusts oxygen and hydrogen to reheat the introduced steam; a third steam turbine to which steam discharged from the combustor is introduced; and a condenser which changes steam discharged from the third steam turbine into condensed water.

First Embodiment

Figure 1:
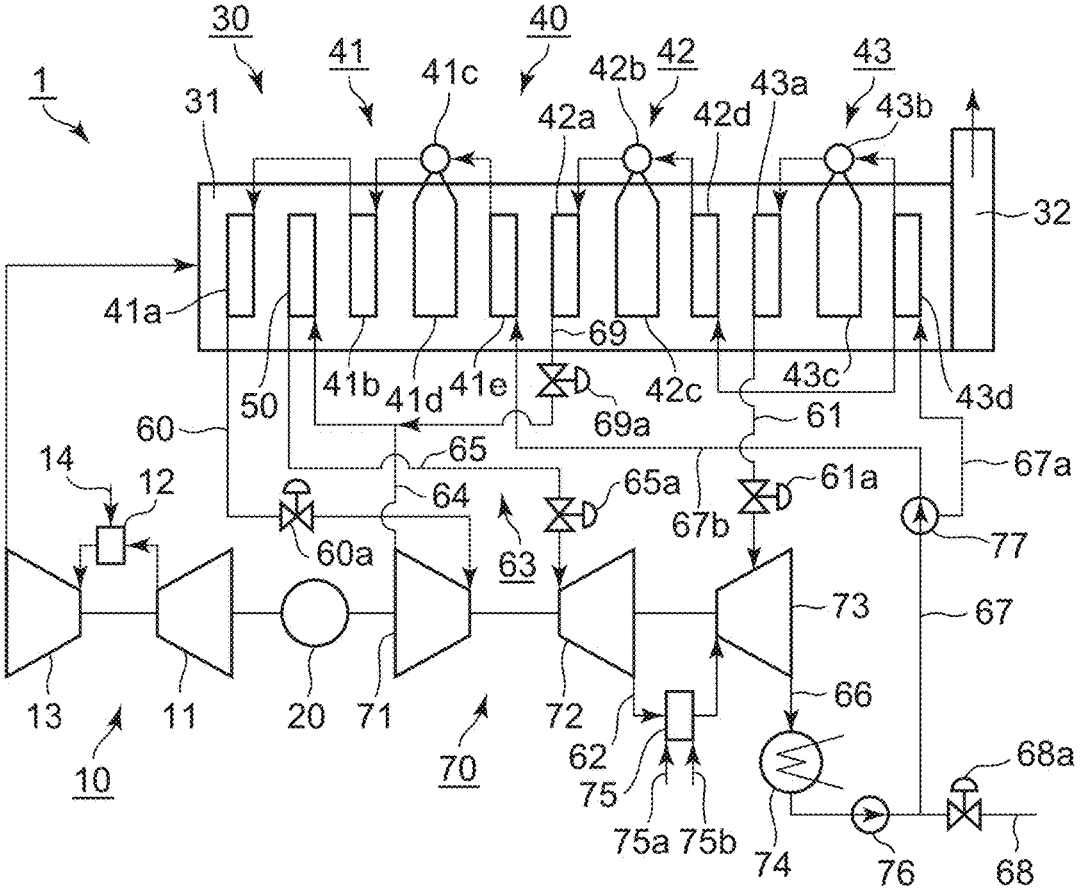
FIG. 1 is a system diagram schematically illustrating a configuration of a combined cycle power generation facility of a first embodiment.

FIG. 1 is a system diagram schematically illustrating a configuration of a combined cycle power generation facility 1 of a first embodiment.

As illustrated in FIG. 1, the combined cycle power generation facility 1 includes a gas turbine 10, a heat recovery steam generator (HRSG) 30, a steam turbine system 70, and a generator 20 as main constituent apparatuses.

The gas turbine 10 includes a compressor 11, a combustor 12, and a turbine 13. The generator 20 is disposed on the same axis as the compressor 11 and the turbine 13. The respective rotors of the compressor 11, the turbine 13, and the generator 20 are configured to integrally rotate.

The compressor 11 sucks and compresses air to supply it to the combustor 12, for example. Fuel is supplied from a fuel supply part 14 to the combustor 12. In the combustor 12, the fuel and the compressed air are combusted, and a combustion gas is produced.

Note that an example of using the compressed air as an oxidant is indicated here, but the oxidant is not limited to air. As the oxidant, for example, oxygen may be used. The fuel is not particularly limited. As the fuel, for example, hydrocarbon such as methane or natural gas, hydrogen, ammonia, a composite fuel of hydrocarbon and hydrogen, a composite fuel of hydrocarbon and ammonia, or the like may be used. Further, as the fuel, for example, a coal gasification gas fuel containing carbon monoxide, hydrogen, and the like, or a coal gasification gas fuel containing ammonia may be used.

The combustion gas produced by the combustor 12 is supplied to the turbine 13 to rotationally move the turbine 13. The generator 20 and the compressor 11 are driven by rotationally moving the turbine 13. The combustion gas discharged from the turbine 13 is guided to a heat recovery steam generator 30 as an exhaust gas.

The heat recovery steam generator 30 includes a flow path 31 to which an exhaust gas from the gas turbine 10 is introduced, a steam generation part 40 and a reheat part 50 provided in the flow path 31, and a smokestack 32 which discharges the exhaust gas passed through the steam generation part 40 to the outside. The steam generation part 40 uses a heat quantity which the exhaust gas has to generate steam. The reheat part 50 uses the heat quantity which the exhaust gas has to reheat steam. Here, the natural circulation-type steam generation part 40 is exemplified and explained. Note that a configuration of the steam generation part 40 may be a forced circulation-type or once-through-type configuration.

The steam generation part 40 includes, for example, a high-pressure steam generation part 41, an intermediate-pressure steam generation part 42, and a low-pressure steam generation part 43. Further, these steam generation parts are disposed in order of the high-pressure steam generation part 41, the intermediate-pressure steam generation part 42, and the low-pressure steam generation part 43 from a side to which the exhaust gas is introduced.

The high-pressure steam generation part 41 includes a first high-pressure superheater 41*a*, a second high-pressure superheater 41*b*, a high-pressure steam drum 41*c*, a high-pressure evaporator 41*d*, and a high-pressure economizer 41*e*. The high-pressure steam drum 41*c* is connected to the high-pressure evaporator 41*d*. The high-pressure economizer 41*e* is coupled to a feed pipe 67*b* which guides feedwater from a condenser 74. Note that here, an example of including the two high-pressure superheaters is indicated, but a configuration to include one high-pressure superheater is applicable.

Water heated by the high-pressure economizer 41*e* is introduced to the high-pressure steam drum 41*c*, and changed into steam by the high-pressure evaporator 41*d*. The steam generated by the high-pressure evaporator 41*d* is guided to the second high-pressure superheater 41*b* and the first high-pressure superheater 41*a* to be superheated. The superheated steam is guided to a high-pressure turbine 71 via a main steam pipe 60.

The intermediate-pressure steam generation part 42 includes an intermediate-pressure superheater 42*a*, an intermediate-pressure steam drum 42*b*, an intermediate-pressure evaporator 42*c*, and an intermediate-pressure economizer 42*d*. The intermediate-pressure steam drum 42*b* is connected to the intermediate-pressure evaporator 42*c*. The intermediate-pressure economizer 42*d* is coupled to, for example, a low-pressure economizer 43*d* via a pipe.

Water supplied from the low-pressure economizer 43*d* is heated in the intermediate-pressure economizer 42*d*. The water heated by the intermediate-pressure economizer 42*d* is introduced to the intermediate-pressure steam drum 42*b*, and changed into steam by the intermediate-pressure evaporator 42*c*. The steam generated by the intermediate-pressure evaporator 42*c* is guided to the intermediate-pressure superheater 42*a* to be superheated. The superheated steam is guided to a low-temperature reheat steam pipe 64 to be described later via a steam pipe 69. A steam valve 69*a* which regulates a flow rate of steam to be introduced to the low-temperature reheat steam pipe 64 is interposed in the steam pipe 69.

The low-pressure steam generation part 43 includes a low-pressure superheater 43*a*, a low-pressure steam drum 43*b*, a low-pressure evaporator 43*c*, and a low-pressure economizer 43*d*. The low-pressure steam drum 43*b* is connected to the low-pressure evaporator 43*c*. The low-pressure economizer 43*d* is coupled to a feed pipe 67*a* which guides the feedwater from the condenser 74.

Water heated by the low-pressure economizer 43*d* is introduced to the low-pressure steam drum 43*b*, and changed into steam by the low-pressure evaporator 43*c*. The steam generated by the low-pressure evaporator 43*c* is guided to the low-pressure superheater 43*a* to be superheated. The superheated steam is guided to a predetermined turbine stage of a low-pressure turbine 73 via a steam supply pipe 61. The steam is introduced to, for example, a turbine stage on a further downstream side than a turbine stage in an initial stage via the steam supply pipe 61. Thus, a turbine output can be increased by introducing the steam via the steam supply pipe 61.

The reheat part 50 is disposed between the first high-pressure superheater 41*a* and the second high-pressure superheater 41*b*, for example. A steam inlet of the reheat part 50 is coupled to the low-temperature reheat steam pipe 64, and a steam outlet of the reheat part 50 is coupled to a high-temperature reheat steam pipe 65.

The steam turbine system 70 includes a plurality of steam turbines, the condenser 74, and a combustor 75. The plurality of steam turbines include the high-pressure turbine 71, an intermediate-pressure turbine 72, and the low-pressure turbine 73. In a flow direction of a steam flow, the intermediate-pressure turbine 72 is provided on a downstream side of the high-pressure turbine 71, and the low-pressure turbine 73 is provided on a downstream side of the intermediate-pressure turbine 72.

Note that the high-pressure turbine 71 functions as a first steam turbine, the intermediate-pressure turbine 72 functions as a second steam turbine, and the low-pressure turbine 73 functions as a third steam turbine.

In a configuration illustrated in FIG. 1, the compressor 11, the turbine 13, the generator 20, the high-pressure turbine 71, the intermediate-pressure turbine 72, and the low-pressure turbine 73 are disposed on the same axis, and their respective rotors are configured to integrally rotate. Note that, for example, the gas turbine 10 and the steam turbines may be coupled to their respective separate generators.

A steam inlet of the high-pressure turbine 71 is coupled to the first high-pressure superheater 41*a* via the main steam pipe 60. A steam valve 60*a* which regulates a flow rate of the steam to be introduced to the high-pressure turbine 71 is interposed in the main steam pipe 60.

A steam outlet of the high-pressure turbine 71 is coupled to a steam inlet of the intermediate-pressure turbine 72 via a reheat steam pipe 63 in which the reheat part 50 is interposed. The reheat steam pipe 63 includes the low-temperature reheat steam pipe 64 connected between the steam outlet of the high-pressure turbine 71 and the reheat part 50, and the high-temperature reheat steam pipe 65 connected between the reheat part 50 and the steam inlet of the intermediate-pressure turbine 72. For example, a steam valve 65*a* which regulates a flow rate of steam to be introduced to the intermediate-pressure turbine 72 is interposed in the high-temperature reheat steam pipe 65.

A steam outlet of the intermediate-pressure turbine 72 is coupled to a steam inlet of the low-pressure turbine 73 via a steam pipe 62. The combustor 75 is interposed in the steam pipe 62.

The combustor 75 combusts the fuel and the oxidant. The combustor 75 includes a fuel supply part 75*a* which supplies the fuel and an oxidant supply part 75*b* which supplies the oxidant. The fuel supplied to the combustor 75 is hydrogen ($H_2$). Further, the oxidant supplied to the combustor 75 is oxygen ($O_2$). Therefore, in the combustor 75, water vapor is produced as a combustion gas.

Further, steam discharged from the intermediate-pressure turbine 72 is introduced to the combustor 75. The combustor 75 reheats the introduced steam by using the produced water vapor. Then, the water vapor produced by the combustor 75 is mixed with the steam discharged from the steam outlet of the intermediate-pressure turbine 72, and is supplied to the low-pressure turbine 73.

Here, the steam pipe 62 may include a bypass pipe (not illustrated) which bypasses the combustor 75. Including the bypass pipe allows a conventional one-stage reheat cycle to be performed without stopping the combined cycle power generation facility 1 when the combustor 75 is stopped to perform maintenance, for example. In this case, in the steam pipe 62, steam valves (not illustrated) are provided individually near an inlet of and near an outlet of the combustor 75. Closing these steam valves allows prevention of an inflow of steam to the combustor 75 when the steam flows through the bypass pipe. Note that the bypass pipe includes a steam valve for regulating a steam flow rate.

Note that here, an example in which the combustor 75 is interposed in the steam pipe 62 is indicated, but the combustor 75 may be provided at the steam inlet portion of the low-pressure turbine 73.

The predetermined turbine stage of the low-pressure turbine 73 is coupled to the low-pressure superheater 43*a* via the steam supply pipe 61. Note that as described previously, the predetermined turbine stage is a turbine stage further downstream than that in the initial stage. A steam valve 61*a* which regulates a flow rate of steam to be introduced to the low-pressure turbine 73 is interposed in the steam supply pipe 61.

A steam outlet of the low-pressure turbine 73 is coupled to the condenser 74 via an exhaust pipe 66. The condenser 74 is coupled to the high-pressure economizer 41*e* and the low-pressure economizer 43*d* via the feed pipes 67, 67*a*, 67*b*. For example, a low-pressure feed pump 76 and a high-pressure feed pump 77 are interposed in the feed pipe 67. Note that the feed pipe 67 is branched into the feed pipe 67*a* and the feed pipe 67*b* at a middle stage of the high-pressure feed pump 77.

Condensed water produced by the condenser 74 is pumped to the high-pressure economizer 41*e* and the low-pressure economizer 43*d* by the low-pressure feed pump 76 and the high-pressure feed pump 77. Note that the feed pipes 67, 67*a*, 67*b*, the low-pressure feed pump 76, and the high-pressure feed pump 77 function as a condensed water supply system.

Further, the feed pipe 67 is provided with a discharge pipe 68 for removing a water quantity equal to the water quantity resulting from condensation of the water vapor produced by the combustor 75 from the condensed water produced by the condenser 74. A flow rate regulating valve 68*a* which regulates the water quantity to be discharged is provided in the discharge pipe 68. The discharge pipe 68 is coupled to, for example, the feed pipe 67 located between the low-pressure feed pump 76 and the high-pressure feed pump 77. Note that the discharge pipe 68 and the flow rate regulating valve 68*a* function as a condensed water discharge system for discharging the water quantity equal to the water quantity resulting from the condensation of the water vapor produced by the combustor 75.

Here, in the steam turbine system 70, the steam introduced to the high-pressure turbine 71 via the main steam pipe 60 rotationally moves the high-pressure turbine 71 to be thereafter discharged to the low-temperature reheat steam pipe 64. The steam discharged to the low-temperature reheat steam pipe 64 is guided to the reheat part 50. At this time, for example, the steam is introduced from the intermediate-pressure superheater 42*a* via the steam pipe 69 to the low-temperature reheat steam pipe 64.

The steam guided to the reheat part 50 via the low-temperature reheat steam pipe 64 is reheated, and guided to the high-temperature reheat steam pipe 65. Then, the steam is introduced to the intermediate-pressure turbine 72 via the high-temperature reheat steam pipe 65.

The steam introduced to the intermediate-pressure turbine 72 rotationally moves the intermediate-pressure turbine 72 to be thereafter discharged to the steam pipe 62. The steam discharged to the steam pipe 62 is introduced to the combustor 75.

The water vapor is produced by the combustion of hydrogen and oxygen in the combustor 75. The water vapor produced by the combustor 75 is mixed with the steam introduced to the combustor 75 to become the steam to be introduced to the low-pressure turbine 73.

Here, a flow rate of the steam to be introduced to the low-pressure turbine 73 increases by a flow rate of the water vapor produced by the combustor 75. Further, a temperature of the steam discharged from the intermediate-pressure turbine 72 rises by being mixed with the water vapor at high temperatures produced by the combustor 75. That is, the steam discharged from the intermediate-pressure turbine 72 is reheated.

A temperature and the flow rate of the steam to be introduced to the low-pressure turbine 73 are regulated by regulating combustion conditions of the combustor 75. For example, the temperature of the steam to be introduced to the low-pressure turbine 73 is regulated to, for example, about the same temperature as a temperature of steam to be introduced to the high-pressure turbine 71.

Thermal efficiency and an output in the low-pressure turbine 73 increase by increasing the temperature of the steam to be introduced to the low-pressure turbine 73, and moreover, increasing the flow rate of the steam to be introduced to the low-pressure turbine 73. That is, the thermal efficiency and the output increase by including the combustor 75.

The steam introduced to the low-pressure turbine 73 rotationally moves the low-pressure turbine 73 to be thereafter discharged to the exhaust pipe 66.

The steam discharged to the exhaust pipe 66 is introduced to the condenser 74, and becomes the condensed water. Note that the condensed water in the condenser 74 is pumped by the low-pressure feed pump 76 and the high-pressure feed pump 77, and guided to the high-pressure economizer 41*e* and the low-pressure economizer 43*d* via the feed pipes 67, 67*a*, 67*b*.

As described above, in the combined cycle power generation facility 1 of the first embodiment, two-stage reheat of the reheat in the combustor 75 and the reheat in the heat recovery steam generator 30 is achieved.

Figure 2:
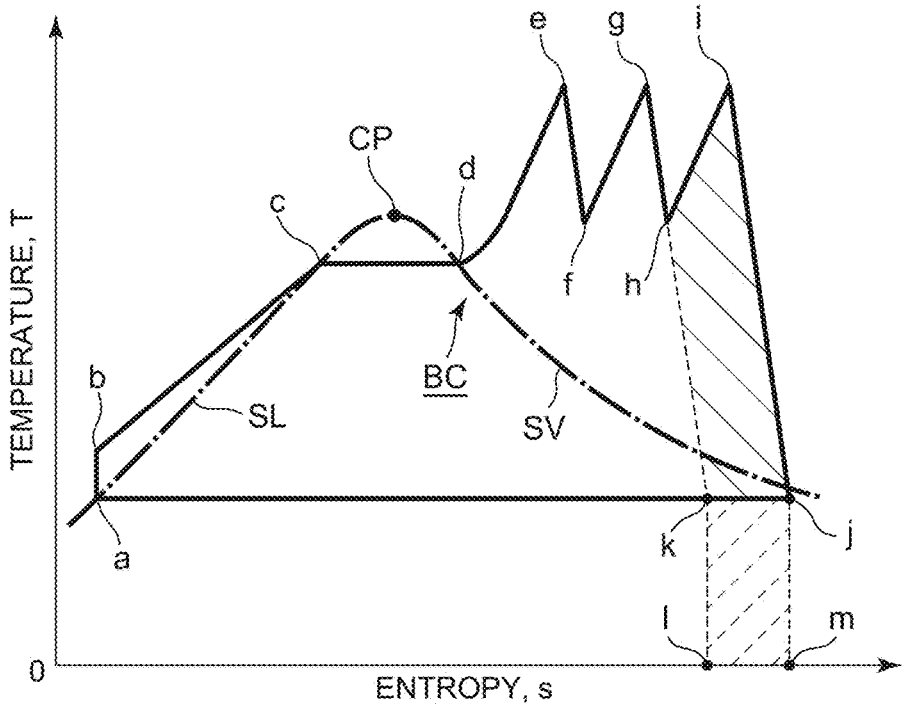
FIG. 2 is a graph illustrating a T-s line graph in the combined cycle power generation facility of the first embodiment.

Here, FIG. 2 is a graph illustrating a T-s line graph in the combined cycle power generation facility 1 of the first embodiment. In FIG. 2, a horizontal axis indicates a specific entropy (kJ/(kg·K)) of steam. A temperature on the horizontal axis is absolute zero. A vertical axis indicates a temperature (K) of steam.

In FIG. 2, a saturation limit line BC is indicated by a dot and dash line. In the saturation limit line BC, a lower entropy side than a critical point CP is a saturated liquid line SL, and a higher entropy side than the critical point CP is a saturated vapor line SV. Note that in FIG. 2, states in a heat cycle of the combined cycle power generation facility 1 are indicated by giving the alphabet a-j.

As illustrated in FIG. 2, a two-stage reheat cycle in the combined cycle power generation facility 1 progresses in order of a state a, a state b, a state c · · · a state j, and the state a. Here, a state between an inlet of the low-pressure feed pump 76 and an inlet of the high-pressure economizer 41*e* is indicated between the state a-the state b, a state between the inlet of the high-pressure economizer 41*e* and an inlet of the high-pressure steam drum 41*c* is indicated between the state b-the state c, a state between the inlet of the high-pressure steam drum 41*c* and an inlet of the second high-pressure superheater 41*b* is indicated between the state c-the state d, a state between the inlet of the second high-pressure superheater 41*b* and the steam inlet of the high-pressure turbine 71 is indicated between the state d-the state e, a state between the steam inlet of the high-pressure turbine 71 and the steam inlet of the reheat part 50 is indicated between the state e-the state f, a state between the steam inlet of the reheat part 50 and the steam inlet of the intermediate-pressure turbine 72 is indicated between the state f-the state g, a state between the steam inlet of the intermediate-pressure turbine 72 and a steam inlet of the combustor 75 is indicated between the state g-the state h, a state between the steam inlet of the combustor 75 and the steam inlet of the low-pressure turbine 73 is indicated between the state h-the state i, a state between the steam inlet of the low-pressure turbine 73 and a steam inlet of the condenser 74 is indicated between the state i-the state j, and a state between the steam inlet of the condenser 74 and the inlet of the low-pressure feed pump 76 is indicated between the state j-the state a.

Here, an example in which reheat in a first stage between the state f-the state g is performed by the reheat part 50, and reheat in a second stage between the state h-the state i is performed by the combustor 75 is indicated.

In FIG. 2, an area surrounded by a, b, c, d, e, f, g, h, i, j corresponds to a net work done in the two-stage reheat cycle in the combined cycle power generation facility 1. Further, an area surrounded by a, b, c, d, e, f, g, h, k corresponds to a net work done in a cycle in a case where the reheat in the second stage is not performed (a case of one-stage reheat) in the combined cycle power generation facility 1.

As illustrated in FIG. 2, a temperature of steam in the state j becomes lower than a temperature of dry saturated steam on the saturated vapor line SV in a specific entropy equal to the specific entropy of the steam in the state j. That is, the steam in the state j becomes wet steam.

The net work done increases more than that in the case of performing one-stage reheat using the heat recovery steam generator 30 by a net work done corresponding to an area surrounded by h, i, j, k by performing the two-stage reheat using the combustor 75 and the heat recovery steam generator 30. Note that in FIG. 2, the section of the net work done to be obtained by the reheat in the combustor 75 is indicated by hatching of solid lines.

Here, an area surrounded by j, k, l, m corresponds to a heat quantity to be heat-dissipated in the condenser 74 of a heat quantity obtained by the reheat in the combustor 75. Note that in FIG. 2, a section of this heat quantity to be heat-dissipated is indicated by hatching of dotted lines.

In FIG. 2, a temperature of steam at the steam inlet of the combustor 75 also depends on a temperature of steam at the steam inlet of the intermediate-pressure turbine 72, and, for example, becomes about 350° C. even under a low condition. A temperature of steam at the steam inlet of the low-pressure turbine 73 becomes, for example, a temperature exceeding 500° C. A temperature at the steam inlet of the condenser 74 becomes, for example, about 30° C.

Thus, the net work done to be obtained by the reheat in the combustor 75 (the area of the hatching of solid lines) is larger than the heat quantity which is a part of the heat quantity obtained by the reheat in the combustor 75, and is heat-dissipated in the condenser 74 (the area of the hatching of dotted lines). Further, an average temperature in a heating process in the combustor 75 (from the state h to the state i) is higher than an average temperature in a heating process excluding the heating process in the combustor 75 (from the state a to the state e and from the state f to the state g). That is, the thermal efficiency of the cycle improves by the reheat in the combustor 75.

Note that the above temperatures of the steams are examples, and these are not restrictive. Here, even in consideration of ranges of the above temperatures of the steams, the net work done to be obtained by the reheat in the combustor 75 (the area of the hatching of solid lines) becomes larger than the heat quantity which is a part of the heat quantity obtained by the reheat in the combustor 75, and is heat-dissipated in the condenser 74 (the area of the hatching of dotted lines).

As described above, according to the combined cycle power generation facility 1 of the first embodiment, including the combustor 75 which combusts hydrogen and oxygen to produce water vapor and reheats steam enables the two-stage reheat while adopting the configuration of the conventional heat recovery steam generator limited to one reheat. That is, the combined cycle power generation facility 1 can perform a total of two reheats of one reheat in the reheat part 50 of the heat recovery steam generator 30 and one reheat in the combustor 75 except the heat recovery steam generator 30 by including the combustor 75.

In the combined cycle power generation facility 1 of the first embodiment, the thermal efficiency of the cycle improves by including such a two-stage reheat cycle.

Further, in the combined cycle power generation facility 1 of the first embodiment, steam at about the same temperature as the temperature of the steam to be introduced to the high-pressure turbine 71 can be introduced to the intermediate-pressure turbine 72 and the low-pressure turbine 73. This improves the thermal efficiency of the cycle.

Moreover, the flow rate of the steam to be introduced to the low-pressure turbine 73 increases by the flow rate of the steam generated in the combustor 75. Thus, the turbine output increases.

Here, as previously described, the fuel to be used for the combustor 12 of the gas turbine 10 is not particularly limited. For example, when the fuel containing hydrocarbon is used for the fuel of the combustor 12 of the gas turbine 10, hydrogen is used as fuel in the combustor 75 in the steam turbine system 70, thus reducing an emission amount of carbon dioxide ($CO_2$) per unit output in the combined cycle power generation facility 1.

That is, in the combined cycle power generation facility 1, a part of the output is obtained by using the water vapor produced by the combustor 75 using the hydrogen fuel. Thus, the emission amount of carbon dioxide ($CO_2$) per unit output in the combined cycle power generation facility 1 is lower than an emission amount of carbon dioxide ($CO_2$) per unit output in a combined cycle power generation facility in which the total output is obtained by the steam generated by using the exhaust gas from the gas turbine 10 using the fuel containing hydrocarbon.

Second Embodiment

Figure 3:
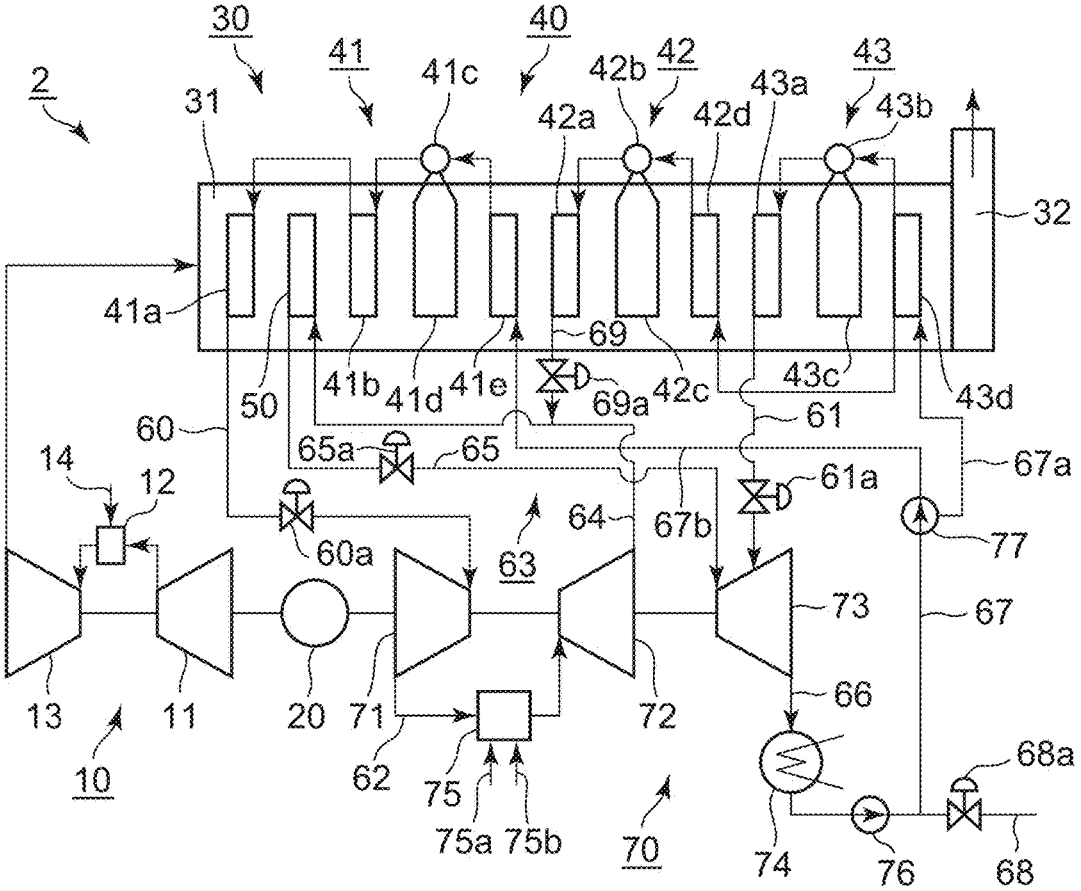
FIG. 3 is a system diagram schematically illustrating a configuration of a combined cycle power generation facility of a second embodiment.

FIG. 3 is a system diagram schematically illustrating a configuration of a combined cycle power generation facility 2 of a second embodiment. Note that in the second embodiment, the same constituent parts as those of the combined cycle power generation facility 1 of the first embodiment are denoted by the same reference signs to omit or simplify redundant explanations.

In the combined cycle power generation facility 2 of the second embodiment, a combustor 75 is disposed between a high-pressure turbine 71 and an intermediate-pressure turbine 72, and steam discharged from the intermediate-pressure turbine 72 is reheated in a heat recovery steam generator 30. Other configurations are the same as the configurations of the combined cycle power generation facility 1 of the first embodiment. Therefore, here, the configuration different from the configuration of the combined cycle power generation facility 1 of the first embodiment will be mainly explained.

As illustrated in FIG. 3, in a steam turbine system 70, a steam inlet of the high-pressure turbine 71 is coupled to a first high-pressure superheater 41*a* via a main steam pipe 60. A steam outlet of the high-pressure turbine 71 is coupled to a steam inlet of the intermediate-pressure turbine 72 via a steam pipe 62. The combustor 75 is interposed in the steam pipe 62. Note that the configuration of the combustor 75 is as previously described.

Here, steam discharged from the high-pressure turbine 71 is introduced to the combustor 75. The combustor 75 reheats the introduced steam by using water vapor produced by combustion of oxygen and hydrogen. Then, the water vapor produced by the combustor 75 is mixed with the steam discharged from the steam outlet of the high-pressure turbine 71, and is supplied to the intermediate-pressure turbine 72.

Note that also in the second embodiment, the steam pipe 62 may include a bypass pipe (not illustrated) which bypasses the combustor 75. In this case, in the steam pipe 62, steam valves are provided individually near an inlet of and near an outlet of the combustor 75. The operation and effect in including the bypass pipe are as explained in the first embodiment.

Note that here, an example in which the combustor 75 is interposed in the steam pipe 62 is indicated, but the combustor 75 may be provided at the steam inlet portion of the intermediate-pressure turbine 72.

A steam outlet of the intermediate-pressure turbine 72 is coupled to a steam inlet of a low-pressure turbine 73 via a reheat steam pipe 63 in which a reheat part 50 is interposed. The reheat steam pipe 63 includes a low-temperature reheat steam pipe 64 connected between the steam outlet of the intermediate-pressure turbine 72 and the reheat part 50, and a high-temperature reheat steam pipe 65 connected between the reheat part 50 and the steam inlet of the low-pressure turbine 73. For example, a steam valve 65*a* which regulates a flow rate of steam to be introduced to the low-pressure turbine 73 is interposed in the high-temperature reheat steam pipe 65.

Note that as previously described, a steam outlet of the low-pressure turbine 73 is coupled to a condenser 74 via an exhaust pipe 66.

Here, in the steam turbine system 70, steam introduced to the high-pressure turbine 71 via the main steam pipe 60 rotationally moves the high-pressure turbine 71 to be thereafter discharged to the steam pipe 62. The steam discharged to the steam pipe 62 is introduced to the combustor 75.

The water vapor is produced by the combustion of hydrogen and oxygen in the combustor 75. The water vapor produced by the combustor 75 is mixed with the steam introduced to the combustor 75 to become steam to be introduced to the intermediate-pressure turbine 72.

Here, a flow rate of the steam to be introduced to the intermediate-pressure turbine 72 increases by a flow rate of the water vapor produced by the combustor 75. Further, a temperature of the steam discharged from the high-pressure turbine 71 rises by being mixed with the water vapor at high temperatures produced by the combustor 75. That is, the steam discharged from the high-pressure turbine 71 is reheated.

A temperature and the flow rate of the steam to be introduced to the intermediate-pressure turbine 72 are regulated by regulating combustion conditions of the combustor 75. For example, the temperature of the steam to be introduced to the intermediate-pressure turbine 72 is regulated to, for example, about the same temperature as a temperature of steam to be introduced to the high-pressure turbine 71.

Thermal efficiency and an output in the intermediate-pressure turbine 72 increase by increasing the temperature of the steam to be introduced to the intermediate-pressure turbine 72, and moreover, increasing the flow rate of the steam to be introduced to the intermediate-pressure turbine 72. That is, the thermal efficiency and the output increase by including the combustor 75.

The steam introduced to the intermediate-pressure turbine 72 rotationally moves the intermediate-pressure turbine 72 to be thereafter discharged to the low-temperature reheat steam pipe 64. The steam discharged to the low-temperature reheat steam pipe 64 is guided to the reheat part 50. At this time, for example, steam is introduced from an intermediate-pressure superheater 42*a* via a steam pipe 69 to the low-temperature reheat steam pipe 64.

The steam guided to the reheat part 50 via the low-temperature reheat steam pipe 64 is reheated, and guided to the high-temperature reheat steam pipe 65. Then, the steam is introduced to the low-pressure turbine 73 via the high-temperature reheat steam pipe 65. The steam introduced to the low-pressure turbine 73 rotationally moves the low-pressure turbine 73 to be thereafter discharged to the exhaust pipe 66.

Here, the flow rate of the steam to be introduced to the low-pressure turbine 73 increases by the flow rate of the water vapor produced by the combustor 75. Thus, the output also increases in the low-pressure turbine 73 by including the combustor 75.

The steam discharged to the exhaust pipe 66 is introduced to the condenser 74, and becomes condensed water. Note that the condensed water in the condenser 74 is pumped by a low-pressure feed pump 76 and a high-pressure feed pump 77, and guided to a high-pressure economizer 41*e* and a low-pressure economizer 43*d* via feed pipes 67, 67*a*, 67*b*.

As described above, in the combined cycle power generation facility 2 of the second embodiment, two-stage reheat of the reheat in the combustor 75 and the reheat in the heat recovery steam generator 30 is achieved.

Figure 4:
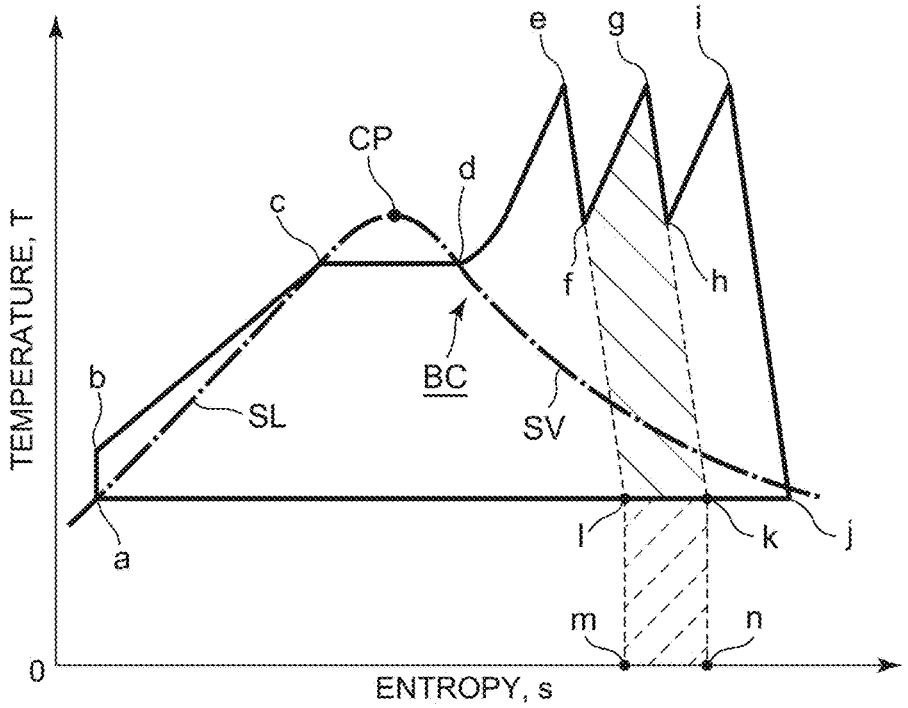
FIG. 4 is a graph illustrating a T-s line graph in the combined cycle power generation facility of the second embodiment.

Here, FIG. 4 is a graph illustrating a T-s line graph in the combined cycle power generation facility 2 of the second embodiment. In FIG. 4, a horizontal axis indicates a specific entropy (kJ/(kg·K)) of steam, and a vertical axis indicates a temperature (K) of steam as in FIG. 2. Note that in FIG. 4, states in a heat cycle of the combined cycle power generation facility 2 are indicated by giving the alphabet a-j.

As illustrated in FIG. 4, a two-stage reheat cycle in the combined cycle power generation facility 2 progresses in order of a state a, a state b, a state c · · · a state j, and the state a. Here, a state between an inlet of the low-pressure feed pump 76 and an inlet of the high-pressure economizer 41*e* is indicated between the state a-the state b, a state between the inlet of the high-pressure economizer 41*e* and an inlet of a high-pressure steam drum 41*c* is indicated between the state b-the state c, a state between the inlet of the high-pressure steam drum 41*c* and an inlet of a second high-pressure superheater 41*b* is indicated between the state c-the state d, a state between the inlet of the second high-pressure superheater 41*b* and the steam inlet of the high-pressure turbine 71 is indicated between the state d-the state e, a state between the steam inlet of the high-pressure turbine 71 and a steam inlet of the combustor 75 is indicated between the state e-the state f, a state between the steam inlet of the combustor 75 and the steam inlet of the intermediate-pressure turbine 72 is indicated between the state f-the state g, a state between the steam inlet of the intermediate-pressure turbine 72 and a steam inlet of the reheat part 50 is indicated between the state g-the state h, a state between the steam inlet of the reheat part 50 and the steam inlet of the low-pressure turbine 73 is indicated between the state h-the state i, a state between the steam inlet of the low-pressure turbine 73 and a steam inlet of the condenser 74 is indicated between the state i-the state j, and a state between the steam inlet of the condenser 74 and the inlet of the low-pressure feed pump 76 is indicated between the state j-the state a.

Here, an example in which reheat in a first stage between the state f-the state g is performed by the combustor 75, and reheat in a second stage between the state h-the state i is performed by the reheat part 50 is indicated.

In FIG. 4, an area surrounded by a, b, c, d, e, f, g, h, i, j corresponds to a net work done in the two-stage reheat cycle in the combined cycle power generation facility 2. Further, an area surrounded by a, b, c, d, e, l corresponds to a net work done in a cycle in a case where reheat is not performed in the combined cycle power generation facility 2. Further, an area surrounded by a, b, c, d, e, f, g, k corresponds to a net work done in a cycle in a case where the reheat in the second stage is not performed (a case of one-stage reheat in the combustor 75) in the combined cycle power generation facility 2.

As illustrated in FIG. 4, a temperature of steam in the state j becomes lower than a temperature of dry saturated steam on a saturated vapor line SV in a specific entropy equal to the specific entropy of the steam in the state j. That is, the steam in the state j becomes wet steam.

The net work done increases more than that in the case of performing one-stage reheat using the heat recovery steam generator 30 by a net work done corresponding to an area surrounded by f, g, k, l by performing the two-stage reheat using the combustor 75 and the heat recovery steam generator 30. Note that in FIG. 4, the section of the net work done to be obtained by the reheat in the combustor 75 is indicated by hatching of solid lines.

Here, an area surrounded by k, l, m, n corresponds to a heat quantity to be heat-dissipated in the condenser 74 of a heat quantity obtained by the reheat in the combustor 75. Note that in FIG. 4, a section of this heat quantity to be heat-dissipated is indicated by hatching of dotted lines.

In FIG. 4, a temperature of steam at the steam inlet of the combustor 75 also depends on a temperature of steam at the steam inlet of the high-pressure turbine 71, and for example, becomes about 350° C. even under a low condition. Further, a temperature of steam at the steam inlet of the intermediate-pressure turbine 72 becomes, for example, a temperature exceeding 500° C. A temperature at the steam inlet of the condenser 74 becomes, for example, about 30° C.

Thus, the net work done to be obtained by the reheat in the combustor 75 (the area of the hatching of solid lines) is larger than the heat quantity which is a part of the heat quantity obtained by the reheat in the combustor 75, and is heat-dissipated in the condenser 74 (the area of the hatching of dotted lines). Further, an average temperature in a heating process in the combustor 75 (from the state f to the state g) is higher than an average temperature in a heating process excluding the heating process in the combustor 75 (from the state a to the state e and from the state h to the state i). That is, the thermal efficiency of the cycle improves by the reheat in the combustor 75.

Note that the above temperatures of the steams are examples, and these are not restrictive. Here, even in consideration of ranges of the above temperatures of the steams, the net work done to be obtained by the reheat in the combustor 75 (the area of the hatching of solid lines) becomes larger than the heat quantity which is a part of the heat quantity obtained by the reheat in the combustor 75, and is heat-dissipated in the condenser 74 (the area of the hatching of dotted lines).

As described above, according to the combined cycle power generation facility 2 of the second embodiment, the same operation and effect as those of the combined cycle power generation facility 1 of the first embodiment are obtained. That is, according to the combined cycle power generation facility 2, including the combustor 75 which combusts hydrogen and oxygen to produce water vapor and heats steam enables the two-stage reheat while adopting the configuration of the conventional heat recovery steam generator limited to one reheat. The thermal efficiency of the cycle improves by including such a two-stage reheat cycle.

Further, in the combined cycle power generation facility 2 of the second embodiment, steam at about the same temperature as the temperature of the steam to be introduced to the high-pressure turbine 71 can be introduced to the intermediate-pressure turbine 72 and the low-pressure turbine 73. This improves the thermal efficiency of the cycle.

Moreover, the flow rate of the steam to be introduced to the low-pressure turbine 73 increases by the flow rate of steam generated in the combustor 75. Thus, the turbine output increases.

Further, when a fuel containing hydrocarbon is used for fuel of a combustor 12 of a gas turbine 10, hydrogen is used as fuel in the combustor 75 in the steam turbine system 70 as previously described, thus reducing an emission amount of carbon dioxide ($CO_2$) per unit output in the combined cycle power generation facility 2.

According to the embodiment explained above, the two-stage reheat is possible, and it becomes possible to improve the thermal efficiency and the output.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A combined cycle power generation facility comprising:

a gas turbine;

a heat recovery steam generator including a steam generation part which uses a heat quantity of an exhaust gas from the gas turbine to generate steam, and a reheat part which reheats steam;

a first steam turbine to which the steam generated by the steam generation part is introduced;

a second steam turbine provided on a downstream side of the first steam turbine in a flow direction of a steam flow;

a reheat steam pipe connecting a steam outlet of the first steam turbine and a steam inlet of the second steam turbine with the reheat part interposed therebetween;

a combustor to which steam discharged from the second steam turbine is introduced, and which combusts oxygen and hydrogen to reheat the introduced steam;

a third steam turbine to which steam discharged from the combustor is introduced; and a condenser which changes steam discharged from the third steam turbine into condensed water, wherein steam at a same temperature as a temperature of the steam to be introduced to the first steam turbine, is introduced to the second steam turbine and the third steam turbine.

2. The combined cycle power generation facility according to claim 1, wherein:

the steam generation part is a first steam generation part which generates a first steam;

the heat recovery steam generator comprises a second steam generation part which generates a second steam with a pressure lower than a pressure of the first steam; and the second steam is introduced to the reheat steam pipe between the steam outlet of the first steam turbine and the reheat part.

3. A combined cycle power generation facility comprising:

a gas turbine;

a heat recovery steam generator including a steam generation part which uses a heat quantity of an exhaust gas from the gas turbine to generate steam, and a reheat part which reheats steam;

a first steam turbine to which the steam generated by the steam generation part is introduced;

a combustor to which steam discharged from the first steam turbine is introduced, and which combusts oxygen and hydrogen to reheat the introduced steam;

a second steam turbine to which steam discharged from the combustor is introduced;

a third steam turbine provided on a downstream side of the second steam turbine in a flow direction of a steam flow;

a reheat steam pipe connecting a steam outlet of the second steam turbine and a steam inlet of the third steam turbine with the reheat part interposed therebetween; and a condenser which changes steam discharged from the third steam turbine into condensed water, wherein steam at a same temperature as a temperature of the steam to be introduced to the first steam turbine, is introduced to the second steam turbine and the third steam turbine.

4. The combined cycle power generation facility according to claim 3, wherein:

the steam generation part is a first steam generation part which generates a first steam;

the heat recovery steam generator comprises a second steam generation part which generates a second steam with a pressure lower than a pressure of the first steam; and the second steam is introduced to the reheat steam pipe between the steam outlet of the second steam turbine and the reheat part.

5. The combined cycle power generation facility according to claim 2, wherein:

the heat recovery steam generator comprises a third steam generation part which generates a third steam with a pressure lower than a pressure of the second steam; and the third steam is introduced to a predetermined turbine stage of the third steam turbine.

6. The combined cycle power generation facility according to claim 1, further comprising a condensed water discharge system for removing a water quantity equal to the water quantity resulting from condensation of water vapor produced by the combustor from condensed water produced by the condenser.

7. The combined cycle power generation facility according to claim 1, further comprising a condensed water supply system which supplies condensed water produced by the condenser to the steam generation part.

* * * * *